US007916881B2

(12) United States Patent
Rohrseitz

(10) Patent No.: US 7,916,881 B2
(45) Date of Patent: Mar. 29, 2011

(54) HEARING DEVICE AND METHOD FOR DETERMINATION OF A ROOM ACOUSTIC

(75) Inventor: Kristin Rohrseitz, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1202 days.

(21) Appl. No.: 11/501,962

(22) Filed: Aug. 10, 2006

(65) Prior Publication Data

US 2007/0036365 A1 Feb. 15, 2007

(30) Foreign Application Priority Data

Aug. 10, 2005 (DE) ..... 10 2005 037 895

(51) Int. Cl.
*H04R 25/00* (2006.01)

(52) U.S. Cl. ..... 381/312; 381/313

(58) Field of Classification Search ..... 381/23.1, 381/60, 312–313, 315–318
See application file for complete search history.

(56) References Cited

U.S. PATENT DOCUMENTS

| | | | | |
|---|---|---|---|---|
| 6,272,229 | B1 | 8/2001 | Baekgaard | |
| 7,058,182 | B2 * | 6/2006 | Kates | 381/312 |
| 7,062,056 | B2 * | 6/2006 | Jonkman | 381/312 |
| 7,463,745 | B2 * | 12/2008 | Miller, III | 381/318 |
| 2005/0226446 | A1 * | 10/2005 | Luo et al. | 381/312 |

FOREIGN PATENT DOCUMENTS

DE 196 11 705 B4 1/2005

* cited by examiner

*Primary Examiner* — Suhan Ni
(74) *Attorney, Agent, or Firm* — Schiff Hardin LLP

(57) ABSTRACT

A hearing device, in particular of a hearing aid, in addition to a first sound output device for acoustic supply to the ear of the user, has a second sound output device for output of a test sound in a room in which the hearing device is located. The hearing device has an acquisition device for acquisition of a response to the test sound from the room. Room acoustic information that can be used to control the signal processing of the hearing device is acquired from the response. The signal processing in the hearing device can be automatically adapted to the current room acoustic.

7 Claims, 1 Drawing Sheet

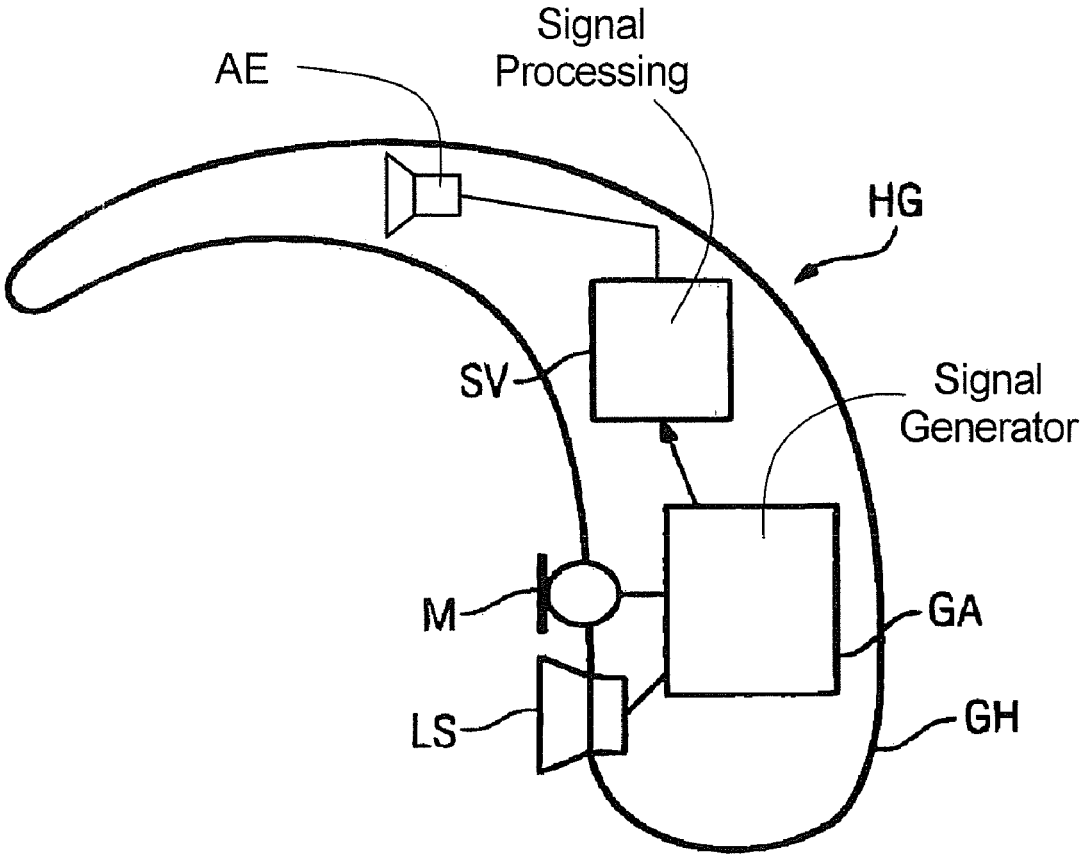
Signal
Processing
AE
HG
SV
Signal
Generator
M
GA
LS
GH

HEARING DEVICE AND METHOD FOR DETERMINATION OF A ROOM ACOUSTIC

BACKGROUND OF THE INVENTION

1. Field of the Invention

The present invention concerns a hearing device, in particular a hearing aid, with a sound output device for acoustic supply to the ear of a user. The present invention concerns a method for determination of a room acoustic.

2. Description of the Prior Art

The surroundings (environment) in which a hearing-impaired happens to be located frequently have an important influence on the usage of hearing devices. For example, a hearing device user can benefit more from specific signal processing algorithms in a reverberant room than in a very small room. The problem is to select the best-suited signal processing for a specific room acoustic.

One way this problem has been addressed, the extent possible, is by the usage of classifiers. Only the acoustic situation (for example, music or speech in interfering noise) is evaluated. The room acoustic as such is not taken into account, but there is a fundamental difference between music heard in a small room and in a large hall.

A hearing device with adaptation of microphones with a phase compensation circuit is known from DE 699 08 662 T2. The phase compensation is based on test sound that is generated in a spatially-defined test sound source.

Moreover, DE 101 38 949 A1 describes a method and an acoustic system for influencing surround sound. A test signal with a known frequency curve can be acquired with a measurement microphone at various positions in the direct acoustic exposure field.

SUMMARY OF THE INVENTION

An object of the present invention is to provide a hearing device with which information about a current room acoustic can be determined. It is also an object to provide a method for determination of information about the room acoustic.

This object is achieved in accordance with the invention by a hearing device, in particular a hearing aid, with a first sound output device for acoustic supply to the ear of a user, a second sound output device (that differs from the first sound output device) for output of a test sound in a room in which the hearing device is located, and an acquisition device for acquisition of a response to the test sound from the room.

Furthermore, according to the invention a method is provided for determination of information about the room acoustic by emitting a test sound hearing device (in particular a hearing aid) in a room in which the hearing device is located, acquisition by the hearing device of a response to the test sound from the room, and determination of the information about the room acoustic from the response.

Information about the room acoustic thus can be acquired by the hearing device in an advantageous manner. This information can then be further processed internally or externally.

The inventive hearing device preferably has a signal generator for generation of a test sound. The test sound does not have to be generated by the typical signal processing device that is present in every hearing device, so that processing capacity can be saved.

The signal generator can be arranged on a single IC chip together with the signal processing device of the hearing device. The production costs for electronics of the entire hearing device thereby decrease.

In a further preferred embodiment, the test sound is generated in the ultrasound range. This has the advantage that no audible noise that can be perceived by the user of the hearing device or, respectively, the hearing aid user is used to measure the room acoustic.

The second sound output device of the inventive hearing device can be a membrane speaker. A standard component thus can be used for generation of the test sound.

The hearing device can also have an analysis device for determination of a room acoustic or corresponding room acoustic information dependent on the response acquired in the acquisition device. This room acoustic information can be used internally or transferred out of the hearing device.

The signal processing device of the hearing device can be adjusted by the analysis device corresponding to the determined room acoustic information. The signal processing thus can be better adapted in an advantageous manner to the current acoustic situation for the person hard of hearing.

DESCRIPTION OF THE DRAWINGS

The single FIGURE is a basic circuit diagram of an embodiment of the inventive hearing aid.

DESCRIPTION OF THE PREFERRED EMBODIMENTS

As shown in the FIGURE a hearing aid HG has a signal generator and signal analyzer GA. A speaker LS that is arranged on the surface of the hearing device housing GH is connected to the signal generator and analyzer GA. The signal generator GA and the speaker LS thus represent an acoustic signal emitter that is installed in the hearing aid HG or its housing GH thereof and is suitable for emission of an acoustic test signal, for example in the ultrasound range.

As is conventional, the hearing aid HG has an acoustic emitter AE that emits an acoustic signal, which has been generated by processing in the signal processing SV, into the ear of a person wearing the hearing aid HG.

The sound radiated from the speaker LS is reflected by the walls of and items in a room and thus transforms into a room response that can be acquired by a microphone M of the hearing aid HG. This microphone M can be a typical hearing aid microphone, but alternatively can be a microphone specifically provided for the acquisition of room responses for determination of the room acoustic. The acquired room response is electrically transduced in the microphone M and sent to the signal generator and analyzer GA. There it is evaluated with regard to room acoustic characteristics, for example whether the room is highly reverberant. The analysis results in an item of room acoustic information with which various room acoustics can possibly be classified in different classes.

The hearing aid-internal signal processing SV is controlled with the acquired room acoustic information or room acoustic class. This means that the signal processing algorithm is adjusted corresponding to the room acoustic. The signal processing in the hearing aid HG is consequently acoustically optimized for the current room acoustic. The quality of the automatic adaptation of the hearing device is thus increased.

The acquisition of the room acoustic information and an automatic adaptation based on this can be used not only for hearing aids but also for other hearing devices such as, for example, headsets, headphones and the like.

Although modifications and changes may be suggested by those skilled in the art, it is the intention of the inventor to embody within the patent warranted hereon all changes and modifications as reasonably and properly come within the scope of her contribution to the art.

I claim as my invention:

1. A hearing device comprising:

a first sound output device that emits an acoustic signal into an ear of a user;

a second sound output device, differing from said first sound output device, that outputs pressure waves forming a test sound in a room in which the first sound output device is located, said test sound interacting with the room and producing a response as a result of the interaction with the room;

a housing adapted to be worn behind the ear of the user, said housing containing said first sound output device, said second sound output device, and said acquisition device; and an acquisition device that detects said response and alters operation of said first sound output device, dependent on said response, said acquisition device comprising an analysis unit that determines information about a room acoustic of said room dependent on said response.

2. A hearing device as claimed in claim 1 wherein said second sound output device comprises a signal generator that generates said test sound.

3. A hearing device as claimed in claim 2 wherein said first sound output device comprises a signal processing device that participates in supplying said acoustic signal to the ear of the user, and wherein said hearing device comprises an electronics chip containing said signal generator and said signal processing device.

4. A hearing device as claimed in claim 1 wherein said second sound output device comprises an ultrasound generator that generates said test sound in the ultrasound range.

5. A hearing device as claimed in claim 1 wherein said second output device comprises a membrane speaker.

6. A hearing device as claimed in claim 1 wherein said first sound output device comprises a signal processor that participates in generating said sound supply to the ear of the user, and wherein said acquisition device supplies said information about said room acoustic to said signal processor and said signal processor participates in generating said sound supply dependent on said information about said room acoustic.

7. A method for operating a hearing aid, comprising the steps of:

in a housing adapted to be worn behind the ear of the user, providing a first sound output device, a second sound output device differing from said first sound output device, and an acquisition device;

from said first sound output device, emitting an acoustic signal into the ear of the user;

from said second sound output device, emitting pressure waves forming a test sound in a room in which the user wearing the housing is located, said test sound interacting with the room and producing a response as a result of the interaction with the room; and with said acquisition device, detecting said response and altering operation of said first sound output device, dependent on said response, by determining, in an analysis unit in said acquisition device, information about a room acoustic of said room dependent on said response.

* * * * *